US005243708A

United States Patent [19]

Vanuch

[11] Patent Number: 5,243,708

[45] Date of Patent: Sep. 14, 1993

[54] DISPOSABLE SCENTED MASK

[76] Inventor: James P. Vanuch, 4812 Detroit Rd., Elyria, Ohio 44035

[21] Appl. No.: 906,412

[22] Filed: Jun. 30, 1992

[51] Int. Cl.[5] ..... A42B 1/18

[52] U.S. Cl. ..... 2/206; 2/9; 2/174; 2/424; 2/171.2; 128/206.29; 128/206.24

[58] Field of Search ..... 2/206, 174, 9, 424, 2/171.2, 174, 173, DIG. 7; 128/206.12, 206.16, 206.18, 206.21, 206.27, 206.28, 206.29, 207.13, 207.11, 201.18, 859, 857, 887, 206.24, 21, 27, 28, 29; 602/74

[56] References Cited

U.S. PATENT DOCUMENTS 1,579,449 4/1926 Hubbell .
2,039,681 5/1936 Chatfield .
3,438,370 4/1969 Krantz, Jr. .
4,248,220 3/1981 White ..... 128/206.16
4,271,834 6/1981 Tanaka .
4,417,575 11/1983 Hilton ..... 128/206.16
4,419,994 12/1983 Hilton ..... 128/206.16
4,503,851 3/1985 Braunroth .
4,941,467 7/1990 Takata .
4,984,302 1/1991 Lincoln ..... 2/206

*Primary Examiner*—Clifford D. Crowder
*Assistant Examiner*—Gloria Hale
*Attorney, Agent, or Firm*—Oldham, Oldham & Wilson

[57] ABSTRACT

A disposable, scented mask having a thickened mouthpiece portion adapting the mask to be held in position while gripped or clutched in the mouth or teeth. A chemically treated portion on the interior of the mask in the area of a wearer's nose allows a pleasant scent to combine with air permeating through the mask material on inhalation to effectively overcome unpleasant odors confronted by a wearer.

10 Claims, 2 Drawing Sheets

DISPOSABLE SCENTED MASK

FIELD OF THE INVENTION AND BACKGROUND

This invention relates to a disposable, scented mask which covers the nose of the wearer and effectively blocks unpleasant odors.

Historically, face masks have been held in position with tie strings or elastic fasteners. And prior art masks designed to overcome unpleasant odors have held the odor masking substance in a sealed envelope located in an aperture for combination with air entering through that aperture.

The face mask disclosed herein, however, is equipped with a mouthpiece portion and held in place by being clenched in the teeth or mouth. The face mask is constructed of a woven cloth or of paper or paper-cloth combination and generally bowl shaped. But in any event, the material utilized must be thin and must have efficient air permeability characteristics. The disposable, scented mask disclosed herein is intended primarily for quick and convenient use and availability in situations where the wearer seeks to avoid experiencing unpleasant odors, where for example the user must change baby diapers, hospital bed pans, personal areas in nursing homes or areas where animal waste is present. And further, the mask would be appropriately used by emergency medical personnel in rescue operations where they may be required to dispose of the remains of decomposed human bodies. Also, the mask would have application in spray paint shops, chemical laboratories, or in any commercial or industrial environment where unpleasant odors would be experienced.

The mask is lightweight, inexpensive, may be kept and marketed in hermetically sealed packaging for storage for indefinite periods of time, and does not require any preparatory activities or activation prior to use. Following each use of the mask for effectively controlling odors, the mask may be discarded and another one substituted.

SUMMARY OF THE INVENTION AND OBJECTS

A general object of this invention is the provision of a mask for use in unpleasant or overpowering odors, which odors would be diverted by use of the mask.

It is a second object of the invention to provide an inexpensive, disposable and scented face mask to cover the nose of the wearer and, thereby to prevent exposure to foul odors; all the while the mask being held in place by the wearer gripping a mouthpiece portion.

A still further object of the invention is to provide a mask to guard the nose against inhalation of noxious odors by application of a somewhat heavy, pleasant scent into the mask, adjacent the wearer's nose, for overcoming the foul odors.

In a preferred embodiment, the mask is formed with an outer curvature and shaped so as to extend over and cover the nose of the wearer and is further provided with a flattened mouthpiece portion, adapted to be gripped by mouth or teeth of the user. The portion of the mask adjacent the wearer's nose incorporates a chemically treated area adapted for inhaling a pleasant smell when in use.

As the wearer breathes within the mask, the odor-masking substance is mixed with the air moving through the thin mask material, thereby effectively overcoming the unpleasant odors.

The objects described above are accomplished by means of this invention as are more specifically described below; but it is to be understood that changes, variations and modifications may be resorted to by those skilled in the art which would fall within the scope of the invention as claimed.

In carrying out the invention in accordance with a preferred embodiment thereof, a thin walled, gas permeable material is provided and formed into a bowl shaped mask for fitting over the nose of a user. The mask has a flattened mouthpiece portion formed of a thicker layer of mask material and designed to be clenched or gripped by the teeth or mouth of a person wearing the mask. Preferably the inner surface of the mask is chemically treated so that a pleasant scent emanates from that inner surface area adjacent the wearer's nose which scent, when mixed with air entering through the mask, effectively overcomes and thereby blocks unpleasant external odors. The mask is preferably composed of relatively inexpensive materials, paper or cloth or combinations thereof, so that the mask may be discarded after it has served the purpose of odor blocking usage.

In another preferred form, the mask may be equipped with a noisemaking device, a clicker formed in the mouthpiece portion, a bell or other noisemaker which would serve to entertain or distract a child in the diaper changing process.

The masks may be wrapped in a hermetically sealed package to prevent dissipation of the chemical application bearing a pleasant scent on the inner surface of the mask.

BRIEF DESCRIPTION OF THE DRAWINGS

The detailed description of the invention which follows is to be read in conjunction with the accompanying drawings, for the purpose of further defining features of the invention, wherein.

DETAILED DESCRIPTION OF THE INVENTION

Figure 1:
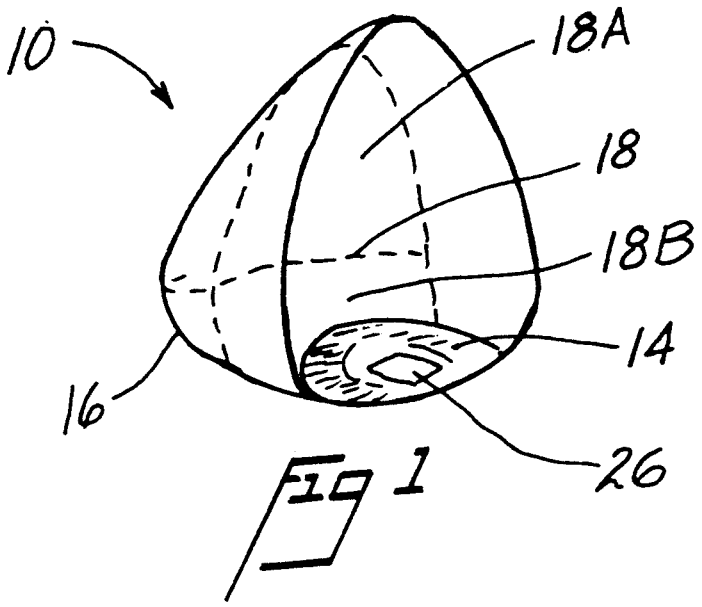
FIG. 1 is an elevational view of the mask indicating both interior and exterior surfaces and illustrates the mask with a thickened mouthpiece portion and chemically scented inner surface area designated by dotted lines.

Reference to FIG. 1 indicates the bowl shaped, disposable mask of the invention 10. A thickened mouthpiece portion 14 of mask material protrudes inwardly from the inner surface of the mask preferably in a horseshoe shape and allows the wearer to hold the mask in place by gripping or clenching the mouthpiece within the teeth or mouth. The mask is preferably formed of paper or a combination paper and cloth material, so long as that material is air permeable. The mask can be manufactured from a mold, by stamping or sealed to the appropriate size, form and contour as illustrated in the drawings.

The mask is thereby inexpensively designed for one-time use and for disposal after that single use. Also, the mask has application to temporary usage for short periods of time when an individual is confronted with offensive odors.

Figure 2:
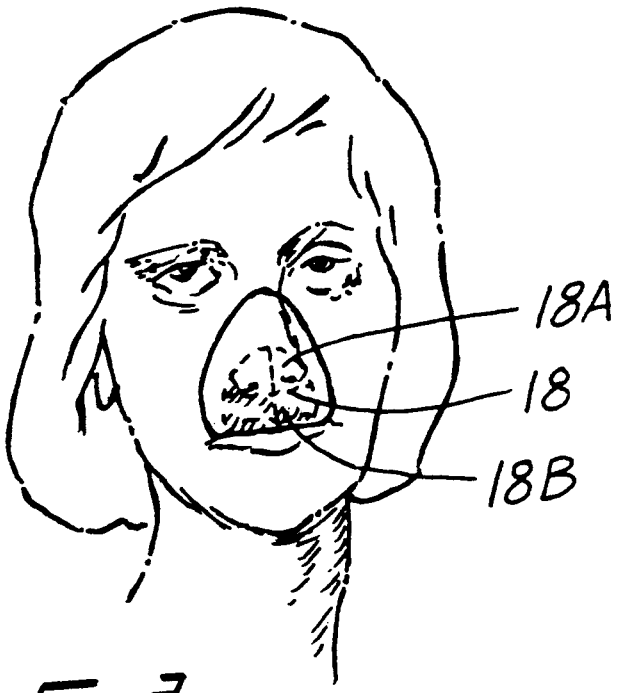
FIG. 2 is a front view of the mask clasped by the wearer when in use.

As illustrated in FIG. 2, by enabling the wearer to grip the mask with the mouth or teeth, the mask can be held in position and the wearer's hands are free. And no tie bands or strings are required to retain the mask in position. The bowl shaped contour 16 of the mask is adapted to cover the nose and enables the wearer to immediately and conveniently clasp the mask in mouth or teeth and hold the mask in position without tying any strings.

FIG. 1 and FIG. 2 also demonstrate a more heavily scented line 18 on the interior surface of the mask adjacent the nostrils; while areas designated 18*a* and 18*b* surrounded by dotted lines indicate areas having a more lightly scented chemical application.

The mask material is sufficiently thin for allowing the wearer to easily inhale and exhale through the mask. And each side 22, 22A, (FIG. 3 and FIG. 4), of the mask has sufficient flexibility to remain stretched against the wearer's face during use.

A fragrant chemical (not shown) or a perfume layer bearing a pleasant scent is applied most heavily along a line 18, which fragrant chemical application is directly on the inner surface of the mask and immediately adjacent the nose to emit a pleasant smell proximate to the wearer. A lighter application of the same chemical bearing a pleasant scent is applied directly on the interior of the mask in areas 18*a*, 18*b*, which are adjacent that center line 18 bearing the heavier chemical scent application.

Figure 3:
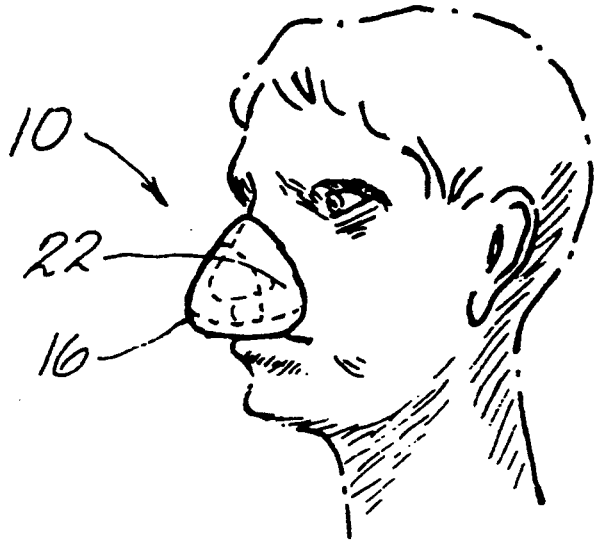
FIG. 3 and FIG. 4 are side views of the scented mask in use illustrating sides of the mask stretched against a wearer's face.
Figure 4:
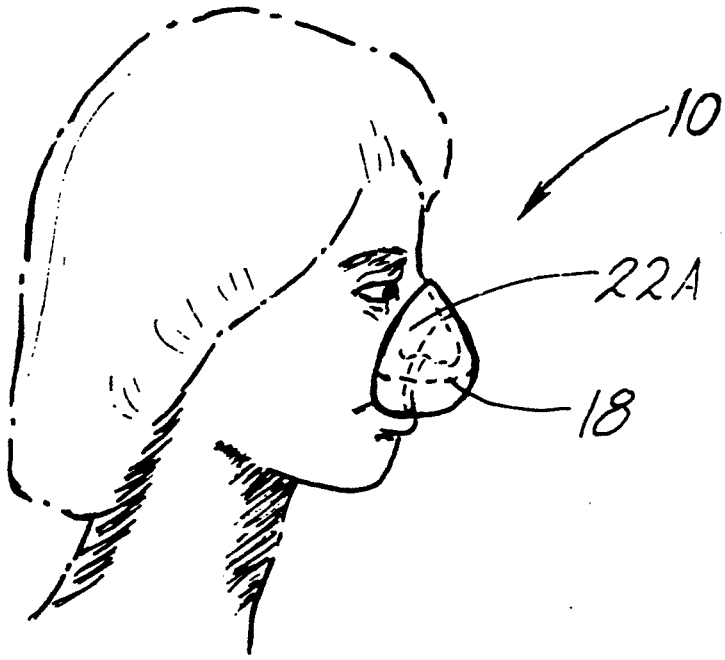

When in use, the bowl shaped mask, (which may also be described as having the shape of a truncated cone), has an edge or rim that is pressed tightly against the nose and face of a wearer, while the mouthpiece is clutched in the mouth or teeth to hold the mask in place as in FIG. 3 and FIG. 4.

Meanwhile, the sides of the mask having the edge or rim are stretched against the face, so that air passing through the mask on inhalation is transferred over the chemically treated area on the inner surface of the mask adjacent the nose for providing a pleasing scent and, thereby, effectively blocking any unpleasant odors which may confront the wearer.

In an alternative embodiment of the invention, a noisemaking device 26 is positioned on the mask for activation by the wearer. This may serve to entertain or distract a child during the diaper changing process. Preferably the noisemaker would be placed on the inner surface of the mask adjacent the mouthpiece to facilitate activation of the noisemaker when the mouthpiece and noisemaker are clamped by the wearer. Typically the noisemaker may be a bell, whistle or clicker device; but preferably, it is a reed for a whistling sound.

While there have been shown and described preferred embodiments of a disposable, scented face mask in accordance with the invention, it will be appreciated that many changes and modifications may be made therein without, however, departing from the essential spirit thereof.

I claim:

1. A thin walled, air permeable and disposable face mask having inner and outer surfaces and a rim, said mask further having sufficient depth to receive and cover the nose of a wearer, comprising:

a means for clenching the mask by teeth or mouth of a wearer to secure the mask in place;

said means comprising an inward protruding portion constructed of mask material thicker than the rest of the mask;

a means for odor-blocking applied on the inner surface of said mask in the area directly opposed to the wearer's nose.

2. The thin walled, air permeable and disposable face mask described in claim 1, wherein said means for clenching is a portion of the mask that protrudes inward on said inner surface, said inward protruding portion having a horseshoe shape to form a mouthpiece to be clenched by teeth or mouth of the wearer.

3. The thin walled, air permeable and disposable face mask described in claim 1, wherein said mouthpiece is integral with the mask, formed of the same material as the mask, is thicker than the rest of the mask, and is positioned on said inner surface such that when said mouthpiece is clenched by the teeth of a wearer, said rim of the mask is pressed tightly against the nose and face of the wearer.

4. The thin walled, air permeable and disposable face mask described in claim 3 above, wherein said means for odor-blocking comprises a chemical bearing a pleasant scent applied directly on said inner surface of the mask adjacent a wearer's nose which chemical, when mixed with air entering through the mask, effectively blocks unpleasant external odors.

5. The thin walled, air permeable and disposable face mask described in claim 4 above, further comprising a noisemaker positioned adjacent the mouthpiece on the inner surface of the mask adapted for activation while the mouthpiece is clamped by a wearer.

6. A thin walled, air permeable and disposable face mask as described in claim 3, wherein the mask is constructed of woven cloth.

7. A thin walled, air permeable and disposable face mask as described in claim 3, wherein the mask is constructed of paper.

8. A thin walled, air permeable and disposable face mask as described in claim 3, wherein the mask is constructed of a combination of paper and cloth.

9. A light weight, thin walled, air permeable and disposable face mask, comprising:

a mask shaped as a truncated cone, and having an opening said cone sufficiently dimensioned to fit over and cover the nose of a wearer; said mask having inner and outer surfaces;

a flat area adjacent the cone opening, the flat area formed of a thickened portion of the same material forming the rest of the mask, the thickened portion shaped like a horseshoe and positioned on the inner surface to form a mouthpiece to be clenched by teeth or mouth to secure the mask in place covering the nose;

a fragrant chemical applied directly on said inner surface of the mask adjacent the nose of a wearer, which chemical when mixed with air entering through the mask, effective blocks unpleasant external odors.

10. The combination described in claim 9 above, further comprising a noisemaker positioned adjacent the mouthpiece portion on the inner surface of the mask, said noisemaker adapted for activation while the mouthpiece is clamped by a person wearing said mask.

* * * * *